US011854325B2

(12) United States Patent
Furst

(10) Patent No.: US 11,854,325 B2
(45) Date of Patent: Dec. 26, 2023

(54) MULTI-FUNCTION, MULTI-TOOL, ELECTRONIC PROTECTIVE KEY FOB

(71) Applicant: Christopher Furst, Encinitas, CA (US)

(72) Inventor: Christopher Furst, Encinitas, CA (US)

( * ) Notice: Subject to any disclaimer, the term of this patent is extended or adjusted under 35 U.S.C. 154(b) by 111 days.

(21) Appl. No.: 17/551,623

(22) Filed: Dec. 15, 2021

(65) Prior Publication Data

US 2022/0198858 A1 Jun. 23, 2022

Related U.S. Application Data

(60) Provisional application No. 63/128,142, filed on Dec. 20, 2020.

(51) Int. Cl.
*G07C 9/00* (2020.01)
*B26B 11/00* (2006.01)
*A44B 15/00* (2006.01)

(52) U.S. Cl.
CPC ..... *G07C 9/00944* (2013.01); *A44B 15/005* (2013.01); *B26B 11/001* (2013.01)

(58) Field of Classification Search
CPC ..... G07C 9/00; G07C 9/00944; G07C 2009/00952; A44B 15/00; A44B 15/005; B26B 11/00; B26B 11/001
USPC ..... 70/395
See application file for complete search history.

(56) References Cited

U.S. PATENT DOCUMENTS 2,371,308 A * 3/1945 Mosch ..... A45C 11/324 206/38.1
4,660,397 A 4/1987 Girimont
2020/0086513 A1 3/2020 Ambielli

FOREIGN PATENT DOCUMENTS

CN 104675200 A * 6/2015
CN 104675200 A 6/2015
CN 205297029 U * 6/2016
CN 205297029 U 6/2016

OTHER PUBLICATIONS

Written Opinion of the International Searching Authority dated Mar. 15, 2022.

* cited by examiner

*Primary Examiner* — Nathan Cumar
(74) *Attorney, Agent, or Firm* — Jacob M. Ward; Ward Law Office LLC

(57) ABSTRACT

An electronic key fob includes a housing defining a recess, a communication system disposed in the housing and having a transceiver and power source that provides power to the transceiver, at least one button disposed in the housing, a tool disposed in the recess of the housing and moveable between a retracted position and an extended position, and a tool lock mechanism. The button is electrically connected to the transceiver. The tool lock mechanism is configured to move between a lock position in which the tool is locked in the retracted position and an unlock position in which the tool can move between the retracted extended position.

18 Claims, 12 Drawing Sheets

CLOSED CIRCUIT

OPEN CIRCUIT

MULTI-FUNCTION, MULTI-TOOL, ELECTRONIC PROTECTIVE KEY FOB

CROSS-REFERENCE TO RELATED APPLICATIONS

This application claims priority to and the benefit of U.S. Provisional Application No. 63/128,142, filed on Dec. 20, 2020. The entire disclosure of the above application is incorporated herein by reference.

FIELD

The present disclosure relates to electronic key fobs, and more particularly, to auxiliary handheld electronic key fobs.

BACKGROUND

The statements in this section merely provide background information related to the present disclosure and may not constitute prior art.

Many vehicles today are equipped with transponder chips that are synced up with a built in chip within the vehicle's handheld electronic key fob device. Vehicular key fobs are small electronic devices, varied in shape and size, to fit within the palm of the hand and are designed to function as an electronic remote control to the car using radio frequency identification and or an encoded infrared beam for that particular vehicle that is linked to the frequency of that specific key fob. The main functionality of vehicular key fobs generally serves the same role as that of a traditional metal key. Each key fob is programmed through a particular set of frequencies to link to a particular door, set of doors, trunk, or ignition of a particular vehicle.

When a user is within the frequency range or distance in which the fob can transmit to the car, they are enabled to lock or unlock doors or trunks, or turn on the vehicle's ignition through the fob, remotely. This provides an additional level of security along with the added convenience of performing these functions for the user remotely through the press of a button on the fob.

Currently, there are many different shapes and sizes of key fobs on the market. The majority using the functionality aforementioned. Some include these functions along with a traditional metal key that is housed within the fob and "flips" out, or is released, of the encasement with a press of a button or lever. Usually, the metal key is made to fit within the ignition located within the steering column of the vehicle. Other electronic key fobs might offer an emergency metal key to use to lock and unlock the car manually in case the electronic components fail within the key fob. Usually this is due to a low or depleted battery within the electronic key fob.

Electronic vehicular key fobs were created primarily for the tasks of locking and unlocking car doors and trunks along with the ability of starting the ignition of the car remotely. Current iterations have expanded on these and other functions that pertain to the functionality of the vehicle and are carried out electronically. However, current key fobs do not have secondary functionalities unrelated to vehicular functions.

Accordingly, there is a need for an electronic key fob having a secondary function unrelated to vehicular functions.

SUMMARY

In concordance with the instant disclosure, an electronic key fob, which can vary in shape and size, which encases auxiliary utility and protective tools for secondary functions unrelated to vehicular functions, is surprisingly discovered.

In one embodiment, an electronic key fob includes a housing defining a recess, a communication system disposed in the housing and having a transceiver and power source that provides power to the transceiver, a tool disposed in the recess of the housing and moveable between a retracted position and an extended position, and a tool lock mechanism. The tool lock mechanism is configured to move between a lock position in which the tool is locked in the retracted position and an unlock position in which the tool can move between the retracted extended position.

In another embodiment, an electronic key fob includes a housing defining a recess, a communication system disposed in the housing and including a transceiver and a power source configured to provide power to the transceiver, and a plurality of buttons disposed in the housing and electrically connected to the transceiver, each button configured to transmit a command via the transceiver. At least two tools are disposed in the recess of the housing, and each tool is configured to move between a retracted position and an extended position. A tool lock mechanism is provided and configured to move between a lock position to lock the at least two tools in the retracted position and an unlock position to selectively permit the at least two tools to move between the retracted position to the extended position.

In various examples, the above embodiments of the electronic key fob can include a thumb screw including a pivot rod extending into the housing and engaging the tool, wherein the tool moves between the retracted position and the extended position via the pivot rod. The thumb screw can be configured to be rotated out of the housing such that the tool is removed from the housing. When the tool lock mechanism is in the lock position, the power source can be electrically connected to the transceiver such that the button is operational, and when the tool lock mechanism is in the unlock position, the power source and transceiver can be electrically disconnected such that the at least one button is non-operational.

In other various examples, the tool is selected from the group consisting of a knife, a bottle opener, and a screwdriver. The electronic key fob can include an auxiliary protection device disposed in the housing, wherein the auxiliary protection device includes at least one of a flashlight, a siren, a pepper spray device, and a radio frequency identification protection device. The electronic key fob can include a compass disposed on the housing. The tool can move between the retracted position and the extended position automatically or manually. The electronic key fob can include at least one button including a tool release button configured to automatically deploy the tool from the retracted position to the extended position when the button is pressed.

In another embodiment, an electronic key fob includes a housing defining a knife recess and a bottle opener recess, a communication system disposed in the housing and including a transceiver and a power source configured to provide power to the transceiver, and a plurality of buttons disposed in the housing and electrically connected to the transceiver, each button configured to transmit a command via the transceiver. The electronic key fob includes a plurality of tools including a knife disposed in the knife recess, a bottle opener disposed in the bottle opener recess, and a compass disposed on a front side of the housing, wherein the knife and the bottle opener are configured to move between a retracted position and an extended position. A tool lock mechanism is provided and configured to slide between a lock position and a unlock position. When the tool lock mechanism is in the lock position, the knife and the bottle opener are locked in the retracted position, and the power source and transceiver are electrically connected such that the plurality of buttons are operational. When the tool lock mechanism is in the unlock position, the knife and the bottle opener can be selectively moved between the retracted position and extended position, and the power source and transceiver are electrically disconnected such that the plurality of buttons are non-operational.

In one example, the electronic key fob includes a thumb screw including a pivot rod extending into the housing and engaging the knife and the bottle opener, wherein the thumb screw is configured to be rotated out of the housing such that the knife and the bottle opener can be removed from the housing.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
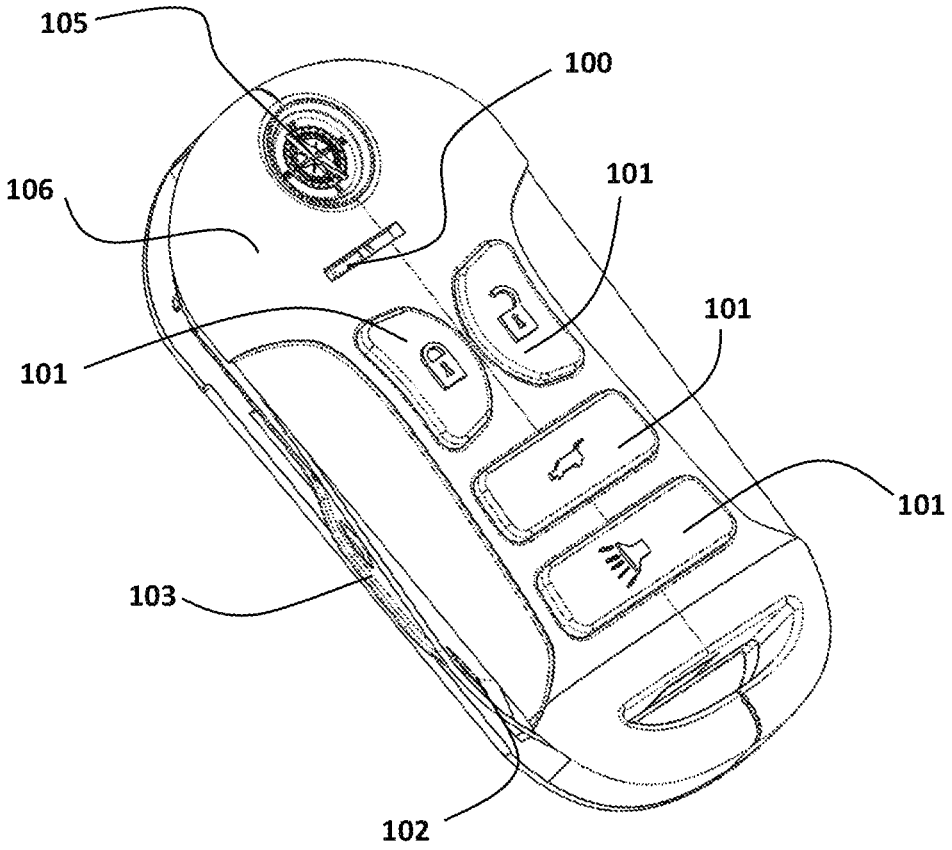
FIG. 1 is a perspective view of an electronic key fob, according to an embodiment of the present disclosure, depicting a built-in knife, a bottle opener, a compass, and a manual lock/unlock tool device.

The following description of technology is merely exemplary in nature of the subject matter, manufacture, and use of one or more inventions, and is not intended to limit the scope, application, or uses of any specific invention claimed in this application or in such other applications as can be filed claiming priority to this application, or patents issuing therefrom. Regarding methods disclosed, the order of the steps presented is exemplary in nature, and thus, the order of the steps can be different in various embodiments, including where certain steps can be simultaneously performed.

The terms "a" and "an" as used herein indicate "at least one" of the item is present; a plurality of such items can be present, when possible. Except where otherwise expressly indicated, all numerical quantities in this description are to be understood as modified by the word "about" and all geometric and spatial descriptors are to be understood as modified by the word "substantially" in describing the broadest scope of the technology. The term "about" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that can arise from ordinary methods of measuring or using such parameters.

Although the open-ended term "comprising," as a synonym of non-restrictive terms such as including, containing, or having, is used herein to describe and claim embodiments of the present technology, embodiments can alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of) even though such additional materials, components or processes are not explicitly recited in this application.

Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter can define endpoints for a range of values that can be claimed for the parameter. For example, if Parameter X is exemplified herein to have value A and also exemplified to have value Z, it is envisioned that Parameter X can have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X can have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it can be directly on, engaged, connected, or coupled to the other element or layer, or intervening elements or layers can be present. In contrast, when an element is referred to as being "directly on," "directly engaged to," "directly connected to" or "directly coupled to" another element or layer, there can be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. can be used herein to describe various elements, components, regions, layers and/or sections, these elements, components, regions, layers and/or sections should not be limited by these terms. These terms can be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

The terms knife, knives, protective tool, and utilitarian tool as used herein can be used interchangeably. The term tool should be viewed within a broad scope as tools, therefore, the terms tool mechanism, articulation, locking and unlocking mechanism fall within the broad scope of tools. The present disclosure could use a wide variety of mechanisms for tool articulation, interchangeability, locking and unlocking, and should not be constrained or confined to one specific method. The principal being took that are housed within an electronic fob encasement that can be articulated either manually or automatically and into a locked or unlocked position that could also be paired with static, stationary tools.

In the figures, a multi-functional, multi-tool, electronic protective key fob is shown according to the present disclosure. The key fob includes utilitarian and protective secondary tools with non-vehicular functions or uses. The key fob can be equipped with tools such knives, a bottle opener, and/or screwdriver, among others. The tools may be articulated and retracted through one or more recesses within the electronic key fob encasement, either manually or automatically activated through a spring, a button, a lever or any other device or mechanism known in the art. For example, automatic articulation can include a spring or a switch blade knife and an example of manual articulation can include a pocket or swiss army knife. In another example, one of the buttons 101 can include an automatic tool release button configured to automatically deploy the tool from the retracted position to the extended position when the button is pressed.

Referring to FIGS. 1-8, an electronic key fob 106 is shown. The electronic key fob 106 can include a front side, a back side, and an exterior with corresponding buttons 101, as shown in FIGS. 1-5. The electronic key fob 106 can be comprised of different plastics, metals, and other materials. The electronic key fob 106 can include electronic devices to be used for various remote controlled operations for the vehicle. The electronic key fob 106 can include various electronics, circuitry, at least one button, levers, and/or mechanisms. In one example, the electronic key fob 106 can include a flip key. Alternatively, the electronic key fob 106 does not include a flip key.

Referring to FIG. 1, a perspective view of the electronic key fob 106 is shown having a plurality of buttons 101 and tools. In the example shown in FIG. 1, the tools of the electronic key fob 106 include a knife 102 and a bottle opener 103 that are in a locked, retracted position, and housed within a recess of the electronic key fob 106. In this example, a tool lock/unlock slider 100 can be slid to the left towards the knife 102 and bottle opener 103 indicating that the knife 102 and the bottle opener 103 are in the locked position and also allowing for a closed circuit so that the buttons 101 are operational and may be used. It should be appreciated that a skilled artisan may scale the size and location of the tool lock/unlock slider 100, as desired, while remaining within the scope of the present disclosure. In one example, the knife 102 and bottle opener 103 are made of stainless steel, however, it should be appreciated that a skilled artisan may select other suitable materials to form the knife 102 and bottle opener 103. Furthermore, it should be appreciated that a skilled artisan may select other variations of tools, as desired. In this example, a compass 105 can be built within a housing of the electronic key fob 106. Other auxiliary devices can be built within the housing of the electronic key fob 106, such as personal protection auxiliary devices. For example, the auxiliary protection device can include a flashlight, a siren, a pepper spray device, and/or a radio frequency identification (RFID) protection device configured to reduce transmitted signal power of a reader to inhibit a microchip in the RFID card from working. In one example, the pepper spray can be Mace® pepper spray available from Mace Security International, Inc., in Cleveland, Ohio.

Figure 2:
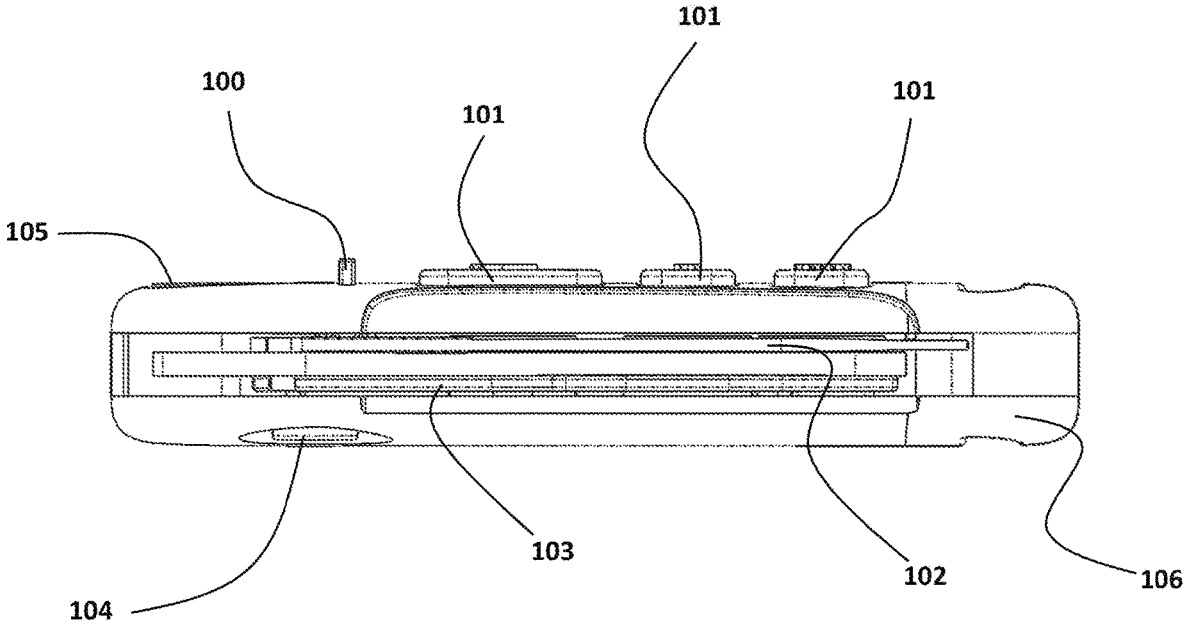
FIG. 2 is a side devotional view of the electronic key fob of FIG. 1, depicting a removable thumb screw for releasing took.

Referring to FIG. 2, a side elevational view of the electronic key fob 106 along with corresponding buttons 101 are illustrated. In one example, the knife 102 and the bottle opener 103 are shown in a locked, retracted position, and housed within the recess of the electronic key fob 106. In this example of the electronic key fob 106, the tool lock/unlock slider 100 can be slid to the left towards the knife 102 and the bottle opener 103 thereby indicating that the knife 102 and the bottle opener 103 are in the locked position and also allowing for a closed circuit so that the buttons 101 are operational and may be used. It should be appreciated that a skilled artisan may employ other suitable tool lock/unlock sliders known in the art, as desired, while remaining within the scope of the present disclosure. As shown in FIG. 2, the electronic key fob 106 can include a release mechanism or thumb screw 104 which acts as a release and interchangeability mechanism for the knife 102 and the bottle opener 103.

Figure 3:
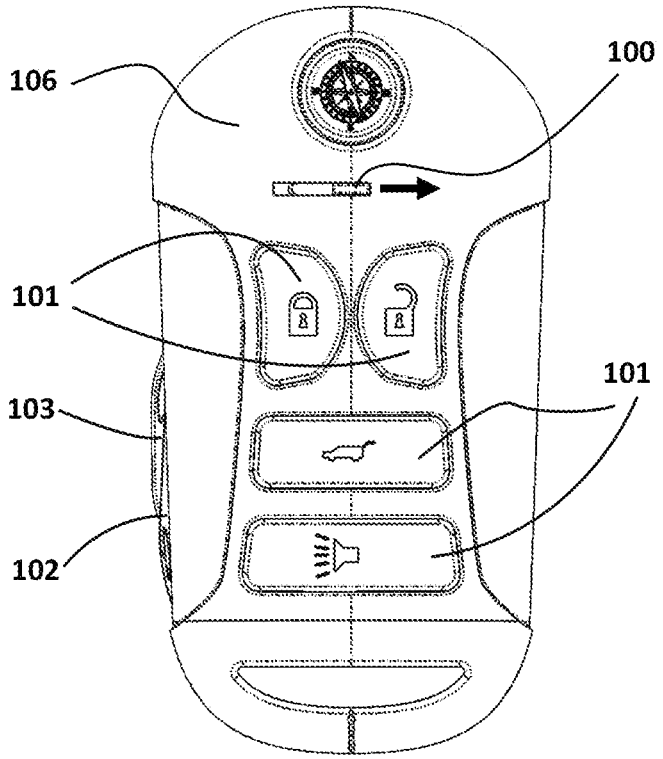
FIG. 3 is a front elevational view of the electronic key fob of FIG. 1.

Referring to FIG. 3, a front plan view of the electronic key fob 106 is shown. In one example, the tool lock/unlock slider 100 can be switched to the right, as indicated by the arrow, to an unlock position that allows for the articulation of housed knife 102 and bottle opener 103 and for the disengagement of key fob buttons 101 through an open circuit.

Figure 4:
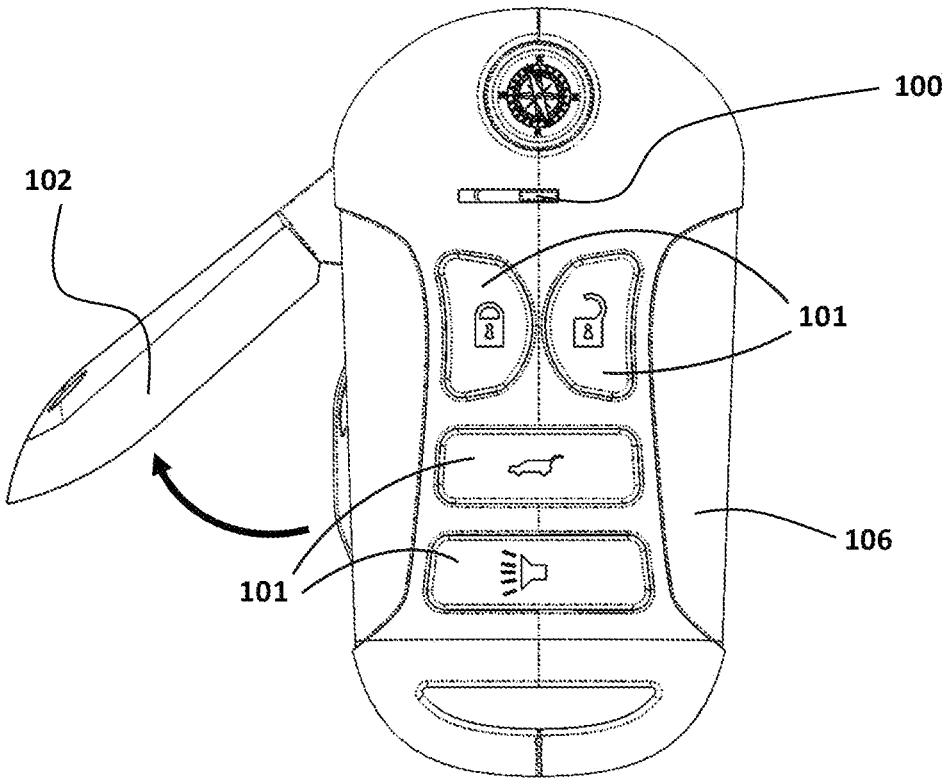
FIG. 4 is a front elevational view of the electronic key fob of FIG. 1, depicting a built-in knife moving from a closed position to an open position.

Referring to FIG. 4, a front plan view of the electronic key fob 106 is shown. As depicted, the tool lock/unlock slider 100 is switched to the right to the unlock position and the knife 102 is shown partially deployed. As noted, with the tool lock/unlock slider 100 in the unlock position, the key fob buttons 101 are disengaged through an open circuit.

Figure 5:
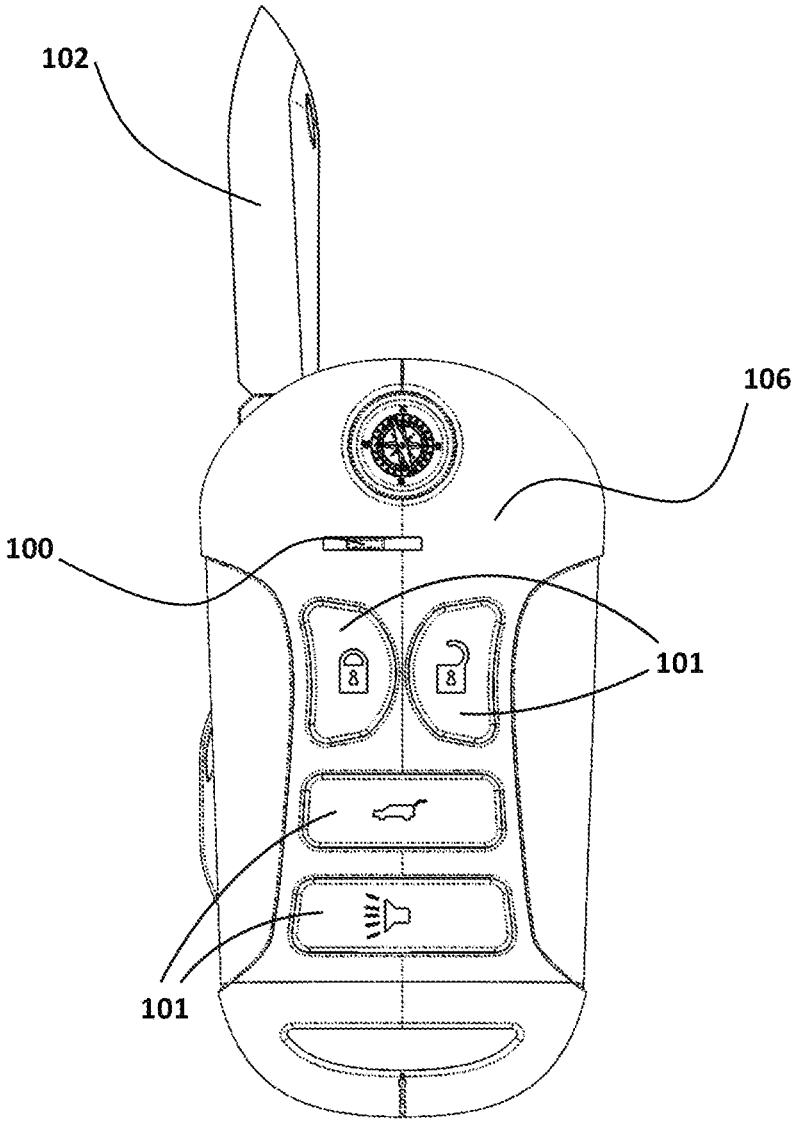
FIG. 5 is a front plan view of the electronic key fob of FIG. 1, depicting a built-in knife locked in an open position.

Referring to FIG. 5, a front plan view of the electronic key fob 106 is shown. As depicted, the tool lock/unlock slider 100 can be switched to the left position in a locked mode having locked knife 102 in a final deployed position and for the disengagement of fob buttons 101 through an open circuit, which is described in greater detail below.

Figure 6:
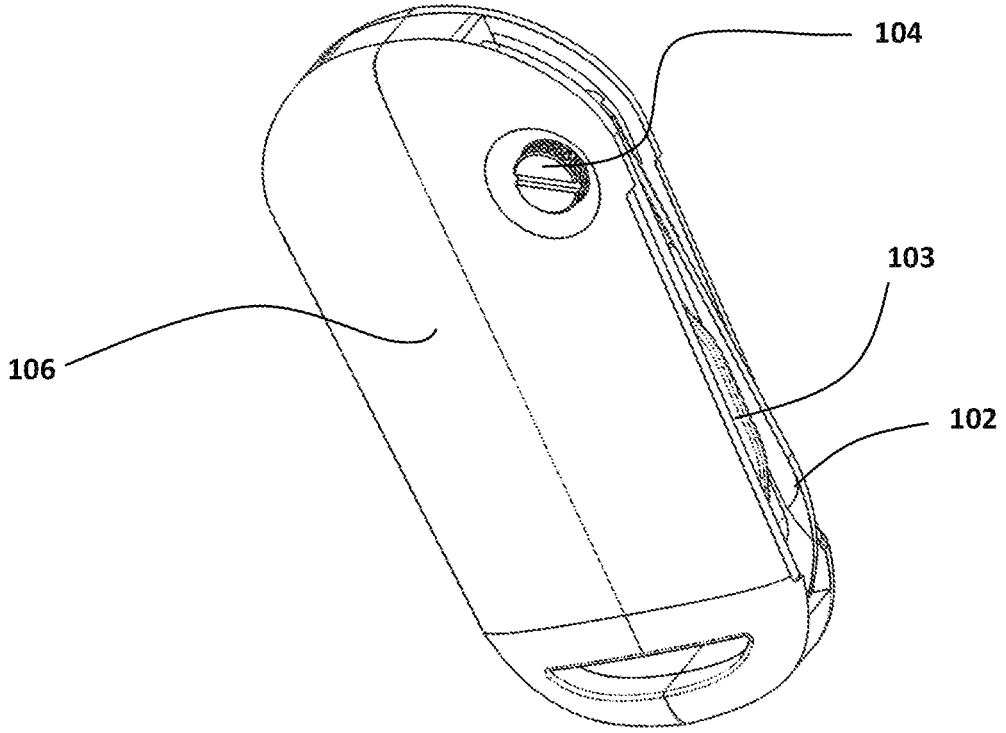
FIG. 6 is a rear perspective view of an electronic key fob, according to the present disclosure, depicting a built-in knife and bottle opener in a closed position, and a removal thumb screw to allow for release and interchangeability of tools.

Referring to FIG. 6, a rear perspective view of the electronic key fob 106 is shown. In one example, the knife 102 and the bottle opener 103 can be housed within the cavity of the electronic key fob 106. The thumb screw 104 is depicted fully screwed into and embedded within the electronic key fob 106. In this example, the tools, e.g., the knife 102 and the bottle opener 103, can use the thumb screw 104 as a pivot rod to articulate to and from the open and closed positions. In this example, the thumb screw 104 can include an indention line wide enough to allow for a penny or dime to fit therein.

Figure 7:
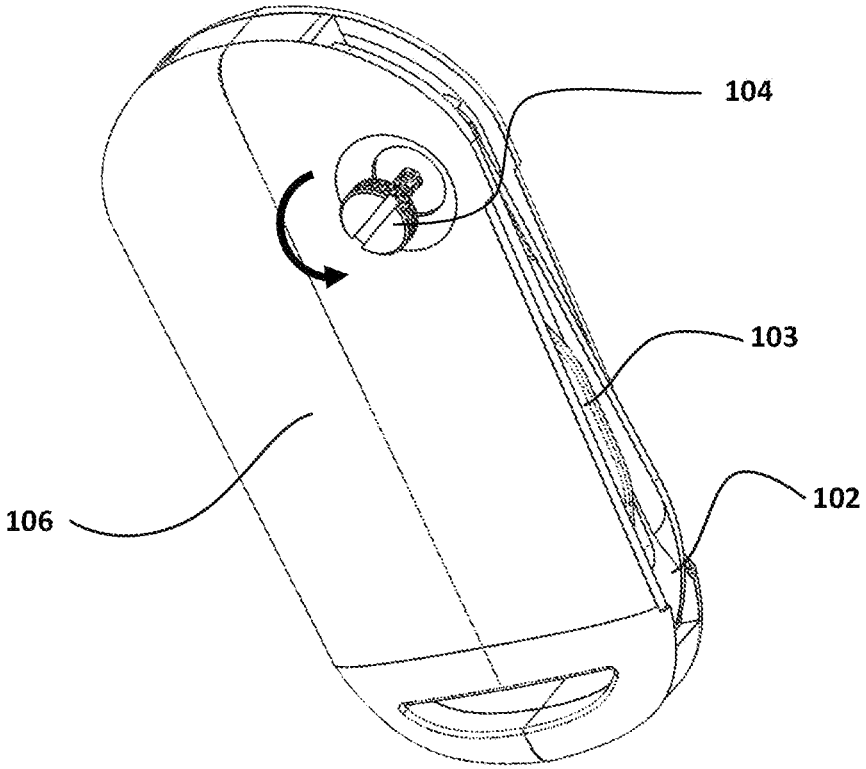
FIG. 7 is a rear perspective view of an electronic key fob, according to the present disclosure, depicting a removal thumb screw rotated counterclockwise and positioned outside of a housing to allow for release and interchangeability of tools.

Referring to FIG. 7, a rear perspective view of the electronic key fob 106 is shown. In one example, the knife 102 and the bottle opener 103 can be housed within the cavity of the electronic key fob 106. The thumb screw 104 can be rotated counterclockwise and out of electronic key fob 106, thus releasing the knife 102 and the bottle opener 103, which are using the thumb screw 104 as a pivot rod. Once the thumb screw 104 has been fully rotated out of the electronic key fob 106, the knife 102 and the bottle opener 103 can be released from or interchanged into electronic key fob 106. It should be appreciated that a skilled artisan may scale the size, shape, material, design, and location of the tools and/or the thumb screw 104, as desired. Furthermore, it should be appreciated that a skilled artisan may select other suitable configurations of the release and interchangeability mechanism for the tools, e.g., the knife 102 and the bottle opener 103.

Figure 8:
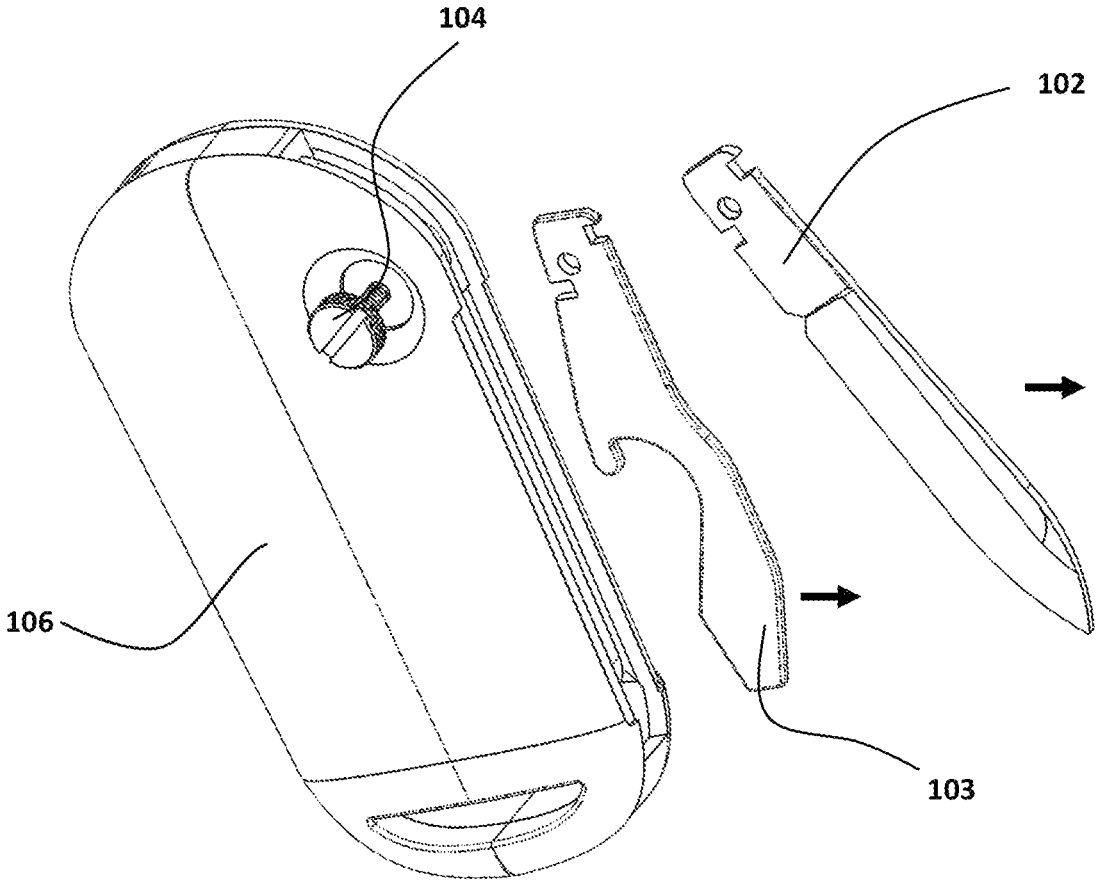
FIG. 8 is a rear perspective view of an electronic key fob, according to the present disclosure, depicting a built-in knife and bottle opener having been released from a housing, and a removal thumb screw that has been rotated counterclockwise and positioned outside of a housing to allow for release and interchangeability of the built-in knife and bottle opener.

Referring to FIG. 8, a rear perspective view of the electronic key fob 106 is shown. As depicted, the knife 102 and the bottle opener 103 are released from the cavity of the electronic key fob 106 by rotating the thumb screw 104 counterclockwise and thus rotating the pivot rod out from the knife 102 and the bottle opener 103. Once the thumb screw 104 has been fully rotated out of the electronic key fob 106, the tools, e.g., the knife 102 and the bottle opener 103, can be released from or interchanged into electronic key fob 106. It should be appreciated that a skilled artisan may scale the size, shape, material, design, and location of the tools and/or the thumb screw 104, as desired. Furthermore, it should be appreciated that a skilled artisan may select other suitable configurations of the release and interchangeability mechanism for the tools, e.g., the knife 102 and the bottle opener 103.

Figure 9A:
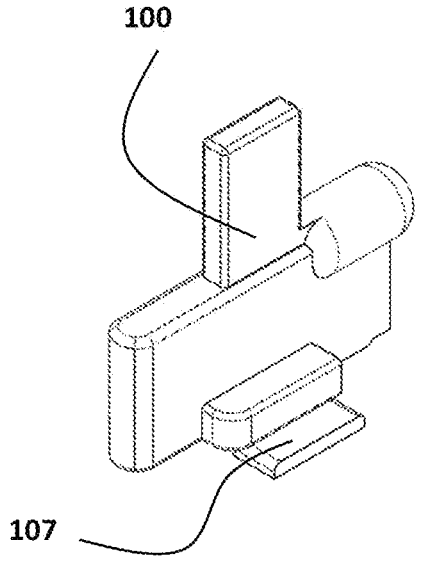
FIG. 9A is a perspective view of a switch having a closed circuit leading to a battery to enable and disable fob buttons within a housing unit of the fob, according to the present disclosure.
Figure 9B:
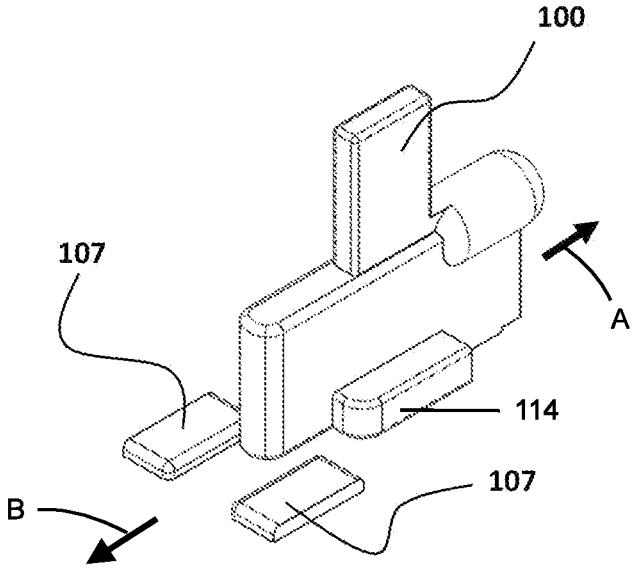
FIG. 9B is a perspective view of a switch having an open circuit leading to a battery to enable and disable fob buttons within a housing unit of the fob, according to the present disclosure.

Referring to FIGS. 9A-9B, perspective views of the tool lock/unlock slider 100 are shown. The tool lock/unlock slider 100 can be configured to serve more than one purpose. In one example, the tool lock/unlock slider 100 can be configured to serve two purposes (1) to lock and unlock the tools, and (2) to open and close the circuitry of a power source of the electronic key fob 106. In one example, the power source can be a battery or a rechargeable battery.

In relation to the first purpose (e.g., to lock and unlock the tools), the tool lock/unlock slider 100 is configured to move between a lock position, an unlock position, and a secondary lock position. Regarding the lock position (FIG. 10B), when the tool lock/unlock slider 100 is slid to the left toward the tools, the tool lock/unlock slider 100 slides into and engages a first notch 110 formed in the tool thereby locking the tool in place when the tool is in the retracted position. Regarding the unlock position (FIG. 10C), when the tool lock/unlock slider 100 is slid to the right, away from the tools, the tool lock/unlock slider 100 is slid out of the first notch 110 to unlock the tool, thereby permitting the tool to move between the retracted position and extended position. Regarding the secondary lock position (FIG. 11C), when the tool lock/unlock slider 100 is slid to the left toward the tool, the tool lock/unlock slider 100 slides into and engages a second notch 112 formed in the tool thereby locking the tool in the extended position permitting the tools to be used.

In relation to the second purpose, FIGS. 9A-9B illustrate the tool lock/unlock slider 100 creating an open and closed circuitry to the power source of the electronic key fob 106. In FIG. 9A, the tool lock/unlock slider 100 can be slid to the left, towards the tools. In one example, the tool lock/unlock slider 100 can be configured to make a connection with the power source terminal 107 creating a closed circuit to the power source of the electronic key fob 106 and thus enabling use of the buttons 101 of the electronic key fob 106. In this position, the tools are locked and within the housing of the electronic key fob 106. FIG. 9B shows the tool lock/unlock slider 100 slid to the right, away from the tools, thus unlocking the tools to be articulated out of the housing of the electronic key fob 106 and into a final articulated position thereby permitting the tools to be used. At this position, the tool lock/unlock slider 100 can lose connection with the power source terminal 107 and thus disengaging the buttons 101 of the electronic key fob 106 from being used while tools are in the final articulated position and being used.

Figure 10A:
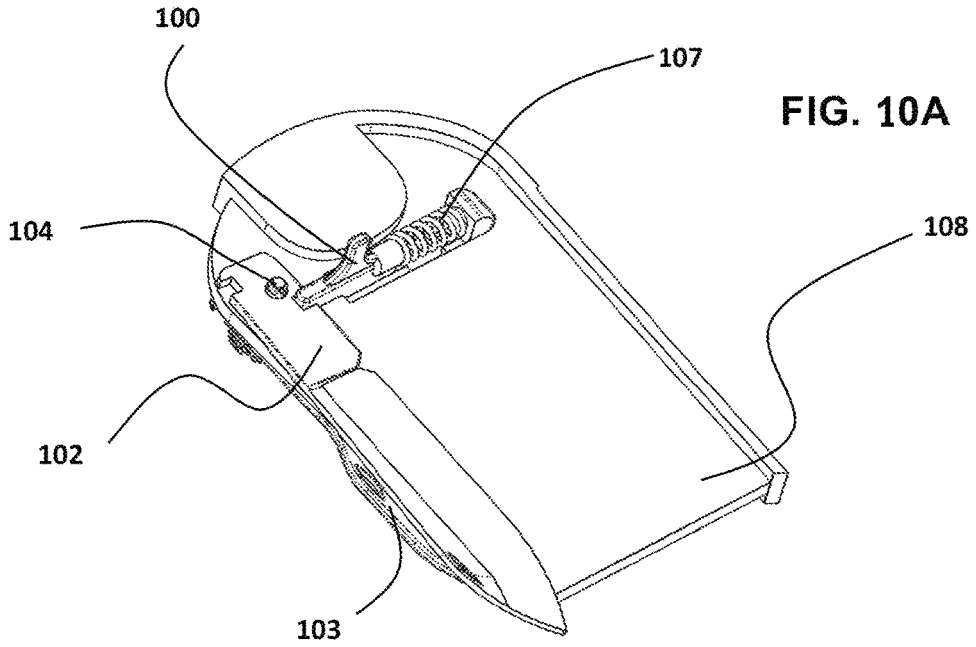
FIG. 10A is a front perspective view of an electronic key fob, according to the present disclosure, depicting a tool locking mechanism in a lock position.
Figure 10B:
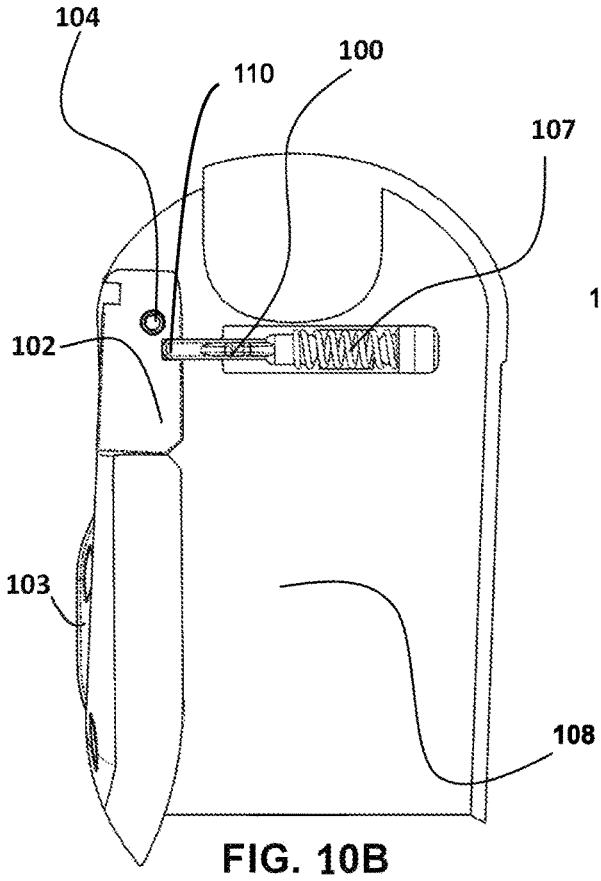
FIG. 10B is a front elevational view of an electronic key fob, according to the present disclosure, depicting a tool locking mechanism in a lock position that also creates a closed circuit leading to the battery to enable fob buttons.
Figure 10C:
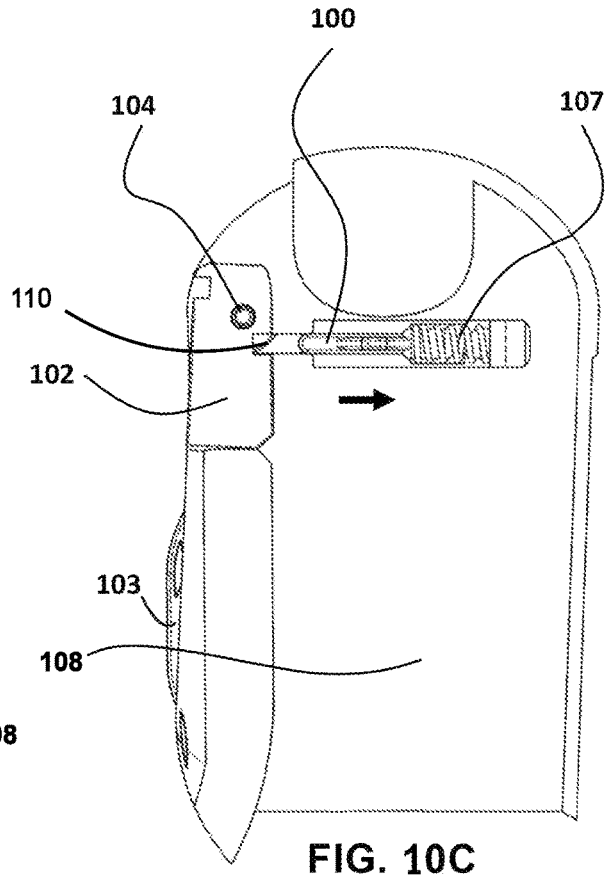
FIG. 10C is a front elevational view of an electronic key fob, according to the present disclosure, depicting a tool locking mechanism in an unlocked position that also creates an open circuit leading to the battery to disable fob buttons.

Referring to FIGS. 10A-10C, the tools, e.g., the knife 102 and the bottle opener 103, and the tool lock/unlock slider 100 are shown. In one example, the tools and the tool lock/unlock slider 100 can be attached to the electronic key fob partition 108 configured to serve as a divider and a foundational platform within the interior of the electronic key fob 106.

FIG. 10A is a front perspective view of the electronic key fob 106 illustrating the tools, e.g., the knife 102 and the bottle opener 103, within the housing of the electronic key fob 106 and within a locked position by the tool lock/unlock slider 100. As previously shown and described above, when the tool lock/unlock slider 100 is positioned to the left toward the tools, a closed circuit connection can be created with the power source terminal 107 enabling use of the buttons 101 of the electronic key fob 106. In FIG. 10A, the thumb screw 104 in which the knife 102 and the bottle opener 103 use as a pivot rod to articulate from is further shown.

FIG. 10B is a front elevational view of the electronic key fob 106 illustrating the tool lock/unlock slider 100 slid to the left towards the knife 102 and the bottle opener 103 and in the locked position. The closed circuit connection is created with the power source terminal 107 enabling use of the buttons 101 of the electronic key fob 106.

FIG. 10C, is a front elevational view of the electronic key fob 106 illustrating the tool lock/unlock slider 100 slid to the right, away from the knife 102 and the bottle opener 103, thereby freeing the knife 102 and the bottle opener 103 to be articulated from the thumb screw 104 pivot rod and out from within the housing of the electronic, key fob 106. As shown and described above, when tool lock/unlock slider 100 is slid to the right, away from the knife 102 and the bottle opener 103, connection with power source terminal 107 can be lost thereby creating an open circuit to the power source, and thus disabling the buttons 101 of the electronic key fob 106 when the fully articulated tool is being used.

Figure 11A:
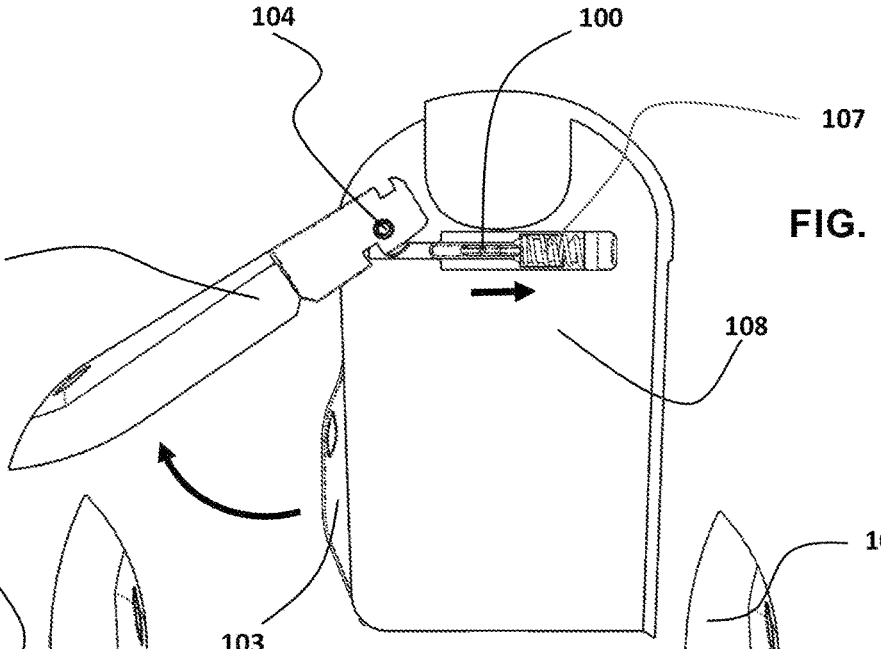
FIGS. 11A-11C are front elevational views of an electronic key fob, according to the present disclosure, depicting a tool locking mechanism creating open and closed circuits leading to a battery to enable and disable fob buttons.
Figure 11B:
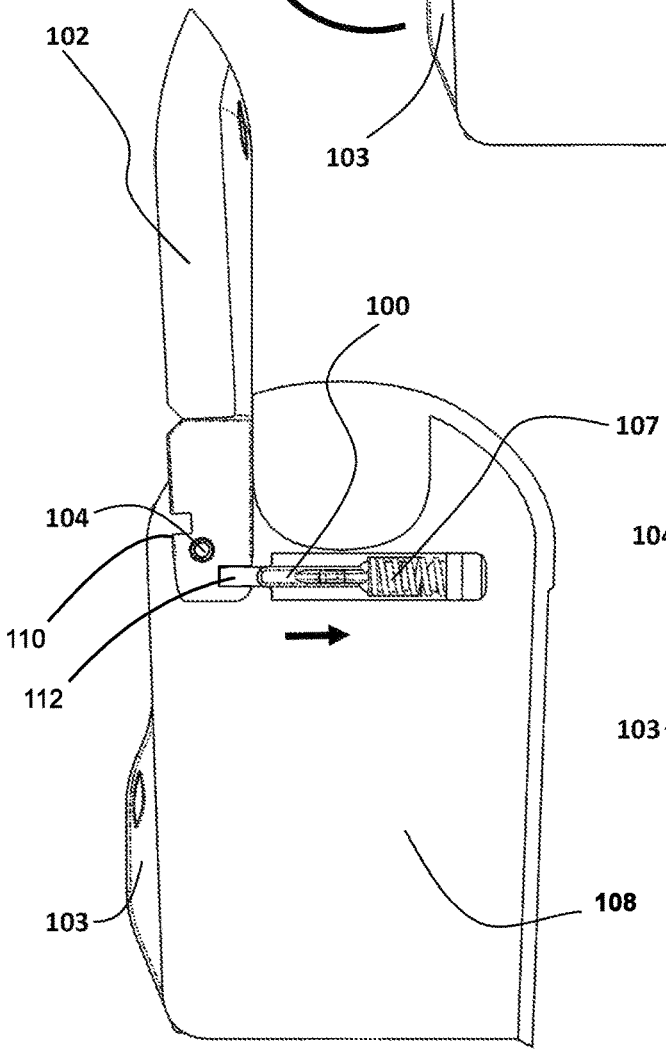
Figure 11C:
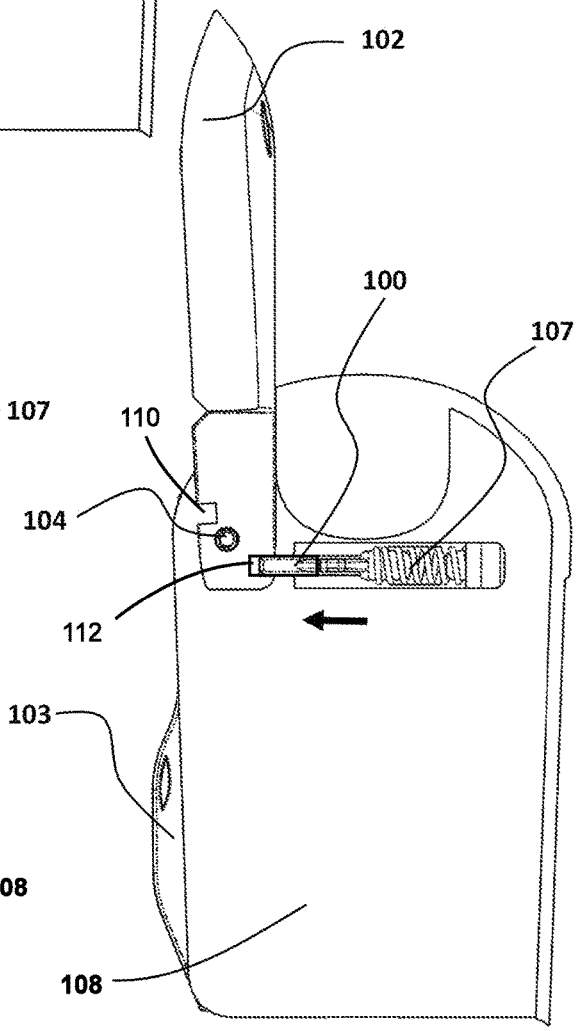

FIGS. 11A-11C are front elevational views of the electronic key fob 106 illustrating the knife 102 being released or unlocked from the tool lock/unlock slider 100 and into the fully locked, articulated state such that the knife 102 can be used.

FIG. 11A shows the tool lock/unlock slider 100 being switched to the right, as indicated by the arrow, away from the knife 102 and the bottle opener 103, thereby unlocking the knife 102 and the bottle opener 103. The knife 102 is articulated from the pivot rod in thumb screw 104 and is depicted partially deployed out of the housing of the electronic key fob 106. Connection with power source terminal 107 can be lost at this position creating an open circuit to the power source of the electronic key fob 106 and disabling the buttons 101 of the electronic key fob 106.

FIG. 11B shows the tool lock/unlock slider 100 being switched to the right, as indicated by the arrow, away from the knife 102 and the bottle opener 103, thereby unlocking the knife 102 and the bottle opener 103. The knife 102 is depicted in a fully articulated position and thus ready to be locked into a position such that the knife 102 can be used. Connection with the power source terminal 107 can be lost at this position creating an open circuit to the power source of the electronic key fob 106 and disabling the buttons 101 of the electronic key fob 106.

FIG. 11C shows the tool lock/unlock slider 100 being switched to the left, as indicated by the arrow, towards the knife 102 and the bottle opener 103, and into the secondary lock position. In the secondary lock position, the tool lock/unlock slider 100 engages with a second notch 112 formed in the knife 102 such that the knife 102 and/or the bottle opener 103 are locked in the fully extended/articulated position. As best shown in FIG. 11B, the second notch 112 is longer in length than the first notch 110 to permit the tool lock mechanism terminal 114 to slide further to the left (indicated by arrow B in FIG. 9B) and past the power source terminal 107. As such, when the tool lock/unlock slider 100 is in the secondary lock position, the knife 102 is locked in the fully extended/articulated position and connection with power source terminal 107 is lost creating an open circuit to the power source of the electronic key fob 106 and disabling the buttons 101 of the electronic key fob 106.

Figure 12:
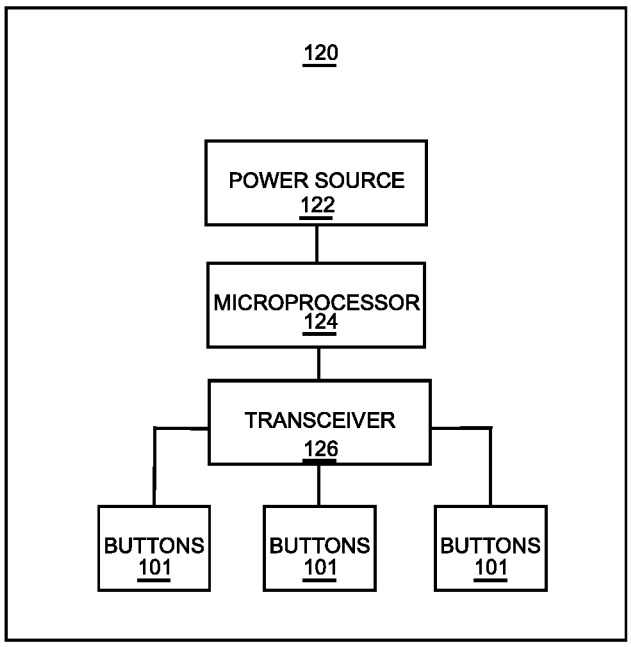
FIG. 12 is a schematic view of a communication system, according to the present disclosure.

FIG. 12 is a schematic view of a communication system 120 disposed in the housing of the electronic key fob 106. The communication system 120 includes the power source 122, a microprocessor 124 electrically connected to the power source 122, a transceiver 126 electrically connected to the microprocessor 124, and at least one button 101. The microprocessor 124 can be configured to activate and deactivate the transceiver 126. The transceiver 126 can be configured to transmit and receive electric signals. When the tool lock mechanism 100 is in the lock position, the power source is electrically connected to the microprocessor 124 and thus, the at least one button 101 is operational. When the tool lock mechanism 100 is in the unlock position, the power source is not electrically connected to the microprocessor 124 and thus, the at least one button 101 is non-operational.

While certain representative embodiments and details have been shown for purposes of illustrating the present disclosure, it will be apparent to those skilled in the art that various changes may be made without departing from the scope of the disclosure, which is further described in the following appended claims.

What is claimed is:

1. An electronic key fob, comprising:

a housing defining a recess;

a communication system disposed in the housing, the communication system including a transceiver configured to transmit and receive electric signals and a power source configured to provide power to the transceiver;

a tool configured to be disposed in the recess of the housing and move between a retracted position and an extended position;

a tool lock mechanism configured to move between a lock position such that the tool is locked in the retracted position and an unlock position such that the tool is operable to move between the retracted position and the extended position; and a thumb screw including a pivot rod extending into the housing and engaging the tool, wherein the tool is operable to move between the retracted position and the extended position via the pivot rod.

2. The electronic key fob of claim 1, wherein the tool is selected from the group consisting of a knife, a bottle opener, and a screwdriver.

3. The electronic key fob of claim 1 further comprising an auxiliary protection device disposed in the housing, wherein the auxiliary protection device includes a member selected from a group consisting of a flashlight, a siren, a pepper spray device, a radio frequency identification protection device, and combinations thereof.

4. The electronic key fob of claim 1 further comprising a compass disposed in the housing.

5. The electronic key fob of claim 1, wherein the tool moves between the retracted position and the extended position manually.

6. The electronic key fob of claim 1 further comprising at least one button disposed in the housing and electrically connected to the transceiver, the at least one button configured to transmit a command via the transceiver, wherein the at least one button includes a tool release button configured to automatically deploy the tool from the retracted position to the extended position when the button is pressed.

7. An electronic key fob, comprising:

a housing defining a recess;

a communication system disposed in the housing, the communication system including a transceiver configured to transmit and receive electric signals and a power source configured to provide power to the transceiver;

a tool configured to be disposed in the recess of the housing and move between a retracted position and an extended position;

a tool lock mechanism configured to move between a lock position such that the tool is locked in the retracted position and an unlock position such that the tool is operable to move between the retracted position and the extended position; and a thumb screw including a pivot rod extending into the housing and engaging the tool, wherein the thumb screw is configured to be rotated out of the housing permitting removal of the tool from the housing.

8. An electronic key fob, comprising:

a housing defining a recess;

a communication system disposed in the housing, the communication system including a transceiver configured to transmit and receive electric signals and a power source configured to provide power to the transceiver;

a tool configured to be disposed in the recess of the housing and move between a retracted position and an extended position;

a tool lock mechanism configured to move between a lock position such that the tool is locked in the retracted position and an unlock position such that the tool is operable to move between the retracted position and the extended position; and at least one button disposed in the housing and electrically connected to the transceiver, the at least one button configured to transmit a command via the transceiver, wherein:

when the tool lock mechanism is in the lock position, the power source is electrically connected to the transceiver such that the at least one button is operational; and when the tool lock mechanism is in the unlock position, the power source is not electrically connected to the transceiver such that the at least one button is non-operational.

9. An electronic key fob, comprising:

a housing defining a recess;

a communication system disposed in the housing, the communication system including a transceiver and a power source configured to provide power to the transceiver;

a plurality of buttons disposed in the housing and electrically connected to the transceiver, each button configured to transmit a command via the transceiver;

at least two tools disposed in the recess of the housing, each tool configured to move between a retracted position and an extended position;

a tool lock mechanism configured to move between a lock position to lock the at least two tools in the retracted position and an unlock position to selectively permit the at least two tools to move between the retracted position to the extended position; and a thumb screw including a pivot rod extending into the housing and engaging the at least two tools, wherein the thumb screw is configured to be rotated out of the housing permitting removal of the at least two tools from the housing.

10. The electronic key fob of claim 9, wherein the at least two tools include members selected from a group consisting of a knife, a bottle opener, and a screwdriver.

11. The electronic key fob of claim 9 further comprising an auxiliary protection device disposed in the housing, wherein the auxiliary protection device includes a member selected from a group consisting of a flashlight, a siren, a pepper spray device, a radio frequency identification protection device, and combinations thereof.

12. The electronic key fob of claim 9 further comprising a compass disposed in the housing.

13. The electronic key fob of claim 9, wherein each of the at least two tools is configured to move between the retracted position and the extended position manually.

14. The electronic key fob of claim 9, wherein the plurality of buttons include a tool release button configured to automatically deploy the at least two tools from the retracted position to the extended position when the tool release button is pressed.

15. An electronic key fob, comprising:

a housing defining a recess;

a communication system disposed in the housing, the communication system including a transceiver and a power source configured to provide power to the transceiver;

a plurality of buttons disposed in the housing and electrically connected to the transceiver, each button configured to transmit a command via the transceiver;

at least two tools disposed in the recess of the housing, each tool configured to move between a retracted position and an extended position;

a tool lock mechanism configured to move between a lock position to lock the at least two tools in the retracted position and an unlock position to selectively permit the at least two tools to move between the retracted position to the extended position; and a thumb screw including a pivot rod extending into the housing and engaging the at least two tools, wherein each tool is operable to move between the retracted position and the extended position via the pivot rod.

16. An electronic key fob, comprising:

a housing defining a recess;

a communication system disposed in the housing, the communication system including a transceiver and a power source configured to provide power to the transceiver;

a plurality of buttons disposed in the housing and electrically connected to the transceiver, each button configured to transmit a command via the transceiver;

at least two tools disposed in the recess of the housing, each tool configured to move between a retracted position and an extended position;

a tool lock mechanism configured to move between a lock position to lock the at least two tools in the retracted position and an unlock position to selectively permit the at least two tools to move between the retracted position to the extended position, when the tool lock mechanism is in the lock position, the power source is electrically connected to the transceiver such that the plurality of buttons is operational; and when the tool lock mechanism is in the unlock position, the power source is not electrically connected to the transceiver such that the plurality of buttons is non-operational.

17. An electronic key fob, comprising:

a housing defining a knife recess and a bottle opener recess;

a compass disposed on a front side of the housing;

a communication system disposed in the housing, the communication system including a transceiver and a power source configured to provide power to the transceiver;

a plurality of buttons disposed in the housing and electrically connected to the transceiver, each button configured to transmit a command via the transceiver;

plurality of tools including a knife disposed in the knife recess, a bottle opener disposed in the bottle opener recess, wherein the knife and the bottle opener are configured to move between a retracted position and an extended position; and a tool lock mechanism configured to slide between a lock position and a unlock position;

wherein:

when the tool lock mechanism is in the lock position, the knife and the bottle opener are configured to be locked in the retracted position, and the power source and transceiver are electrically connected such that the plurality of buttons are operational, and when the tool lock mechanism is in the unlock position, the knife and the bottle opener are configured to be selectively moved between the retracted position and extended position, and the power source and transceiver are electrically disconnected such that the plurality of buttons are non-operational.

18. The electronic key fob of claim 17 further comprising a thumb screw including a pivot rod extending into the housing and engaging the knife and the bottle opener, wherein the thumb screw is configured to be rotated out of the housing permitting removal of the knife and the bottle opener from the housing.

* * * * *